US008007324B2

(12) United States Patent
Wang et al.

(10) Patent No.: US 8,007,324 B2
(45) Date of Patent: Aug. 30, 2011

(54) ELECTRICAL CONNECTOR WITH IMPROVED FASTENING DEVICE

(75) Inventors: Li-Bin Wang, Kunshan (CN); Chin-Pao Kuo, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/958,361

(22) Filed: Dec. 1, 2010

(65) Prior Publication Data

US 2011/0130047 A1 Jun. 2, 2011

(30) Foreign Application Priority Data

Dec. 2, 2009 (CN) ..... 2009 2 0316396

(51) Int. Cl.
*H01R 24/00* (2011.01)

(52) U.S. Cl. ..... 439/660

(58) Field of Classification Search ..... 439/660, 439/351, 248, 626, 177, 166, 677
See application file for complete search history.

(56) References Cited

U.S. PATENT DOCUMENTS

| | | | | |
|---|---|---|---|---|
| 6,065,993 | A * | 5/2000 | Lai et al. | 439/402 |
| 7,758,374 | B2 * | 7/2010 | Yu et al. | 439/493 |
| 7,794,273 | B2 * | 9/2010 | Xu et al. | 439/555 |
| 7,815,459 | B2 * | 10/2010 | Chen et al. | 439/351 |
| 2004/0092164 | A1 * | 5/2004 | Lee | 439/606 |
| 2008/0003874 | A1 * | 1/2008 | Ko | 439/579 |
| 2009/0275244 | A1 * | 11/2009 | Chen et al. | 439/676 |
| 2010/0151715 | A1 * | 6/2010 | Wang et al. | 439/248 |
| 2011/0034086 | A1 * | 2/2011 | Chen et al. | 439/660 |

FOREIGN PATENT DOCUMENTS

TW M292799 6/2006

* cited by examiner

*Primary Examiner* — Chandrika Prasad
(74) *Attorney, Agent, or Firm* — Wei Te Chung; Andrew C. Cheng; Ming Chieh Chang

(57) ABSTRACT

An electrical connector includes a housing located in the front of the electrical connector, a plurality of contacts received in the housing, a plurality of cables connected to the contacts, and a cover assembled on the housing. The housing further includes a base portion, a mating portion frontward extending from the base portion and defining a mating direction, and a fastening portion rearward extending from the base portion. The fastening portion includes a bottom surface defining an inclined plane, and an angle is formed between the horizontal plane and the inclined plane.

20 Claims, 6 Drawing Sheets

ELECTRICAL CONNECTOR WITH IMPROVED FASTENING DEVICE

BACKGROUND OF THE INVENTION

1. Field of the Invention

The present invention relates generally to an electrical connector, and more particularly to an electrical connector used in electric device and having improved fastening device.

2. Description of the Prior Art

Serial Advanced Technology Attachment (SATA) connectors are widely used in electric device such as notebooks. TW Patent No. M292799, issued to HSIAO on Jun. 21, 2006, discloses a SATA connector. The SATA connector comprises a housing, a plurality of wing pieces extending from the two sides of housing. The wing piece has a hole for the SATA connector being assembled in an electric device. However, the above SATA is not suit for slantwise space of the electric device.

Hence, in this art, an improved electrical connector to overcome the above-mentioned disadvantages of the prior art should be provided.

BRIEF SUMMARY OF THE INVENTION

A primary object, therefore, of the present invention is to provide an electrical connector with an improved fastening device.

In order to implement the above object, the electrical connector comprises a housing located in the front of the electrical connector, a plurality of contacts received in the housing, a plurality of cables connected to the contacts, and a cover assembled on the housing. The housing further comprises a base portion, a mating portion frontward extending from the base portion and defining a mating direction, and a fastening portion rearward extending from the base portion. The fastening portion comprises a bottom surface defining an inclined plane which an angle is formed between the horizontal plane and.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
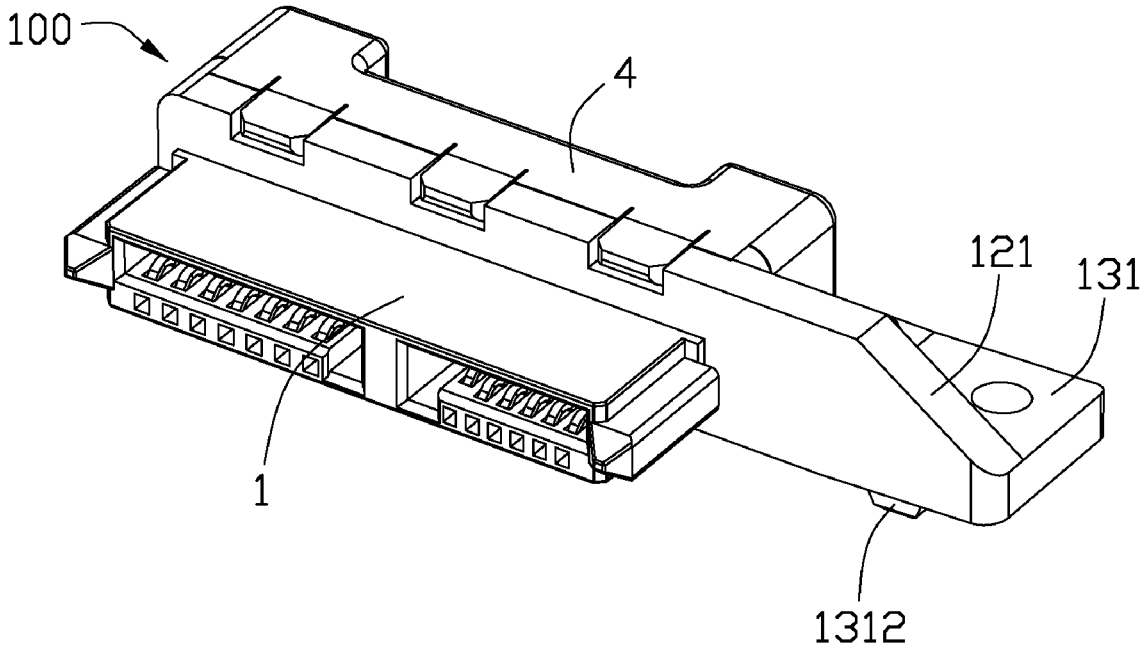
FIG. 1 is a perspective view of an electrical connector assembly in according with the present invention.
Figure 2:
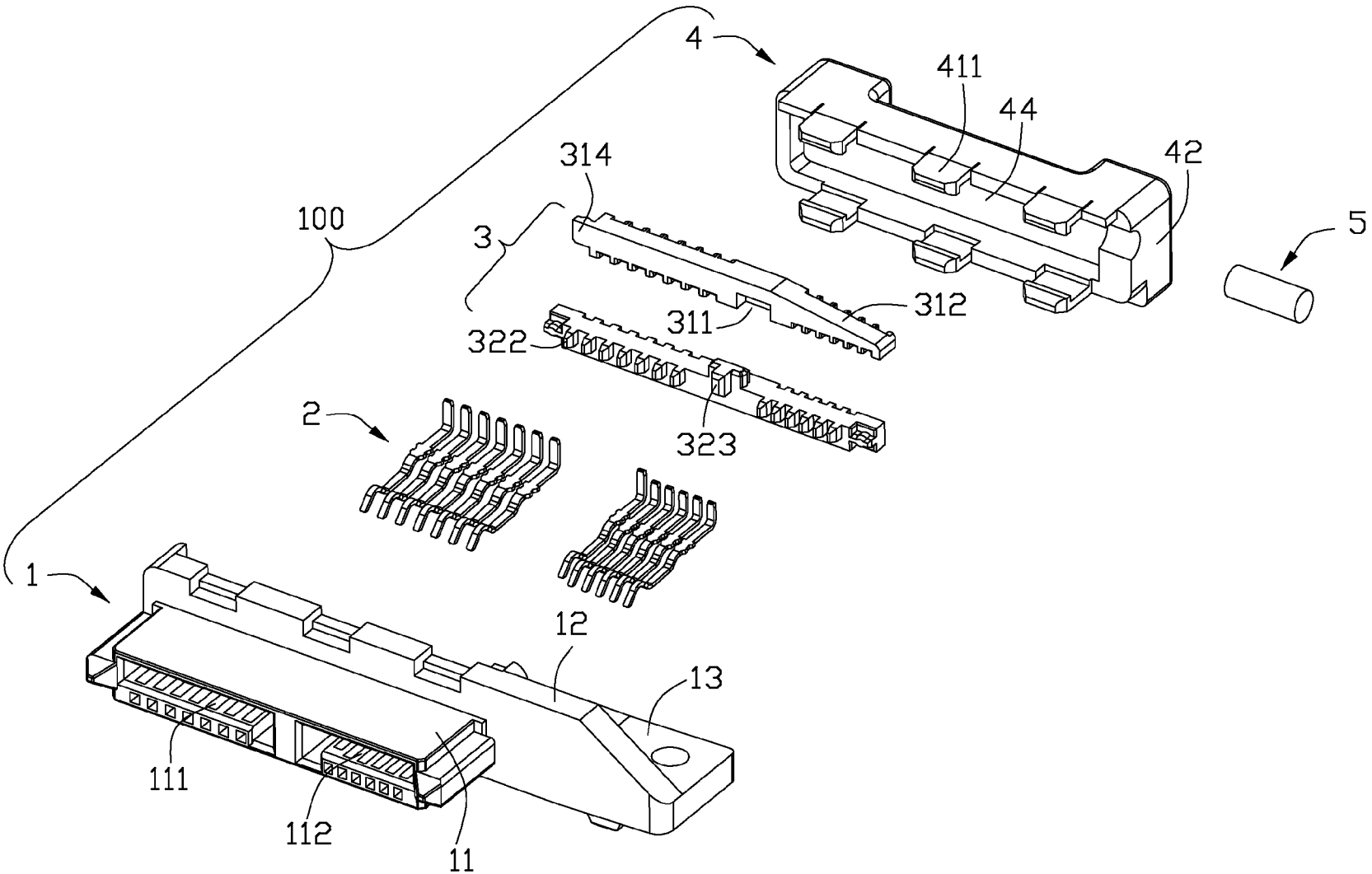
FIG. 2 is an exploded, perspective view of the electrical connector assembly in according with the present invention.
Figure 3:
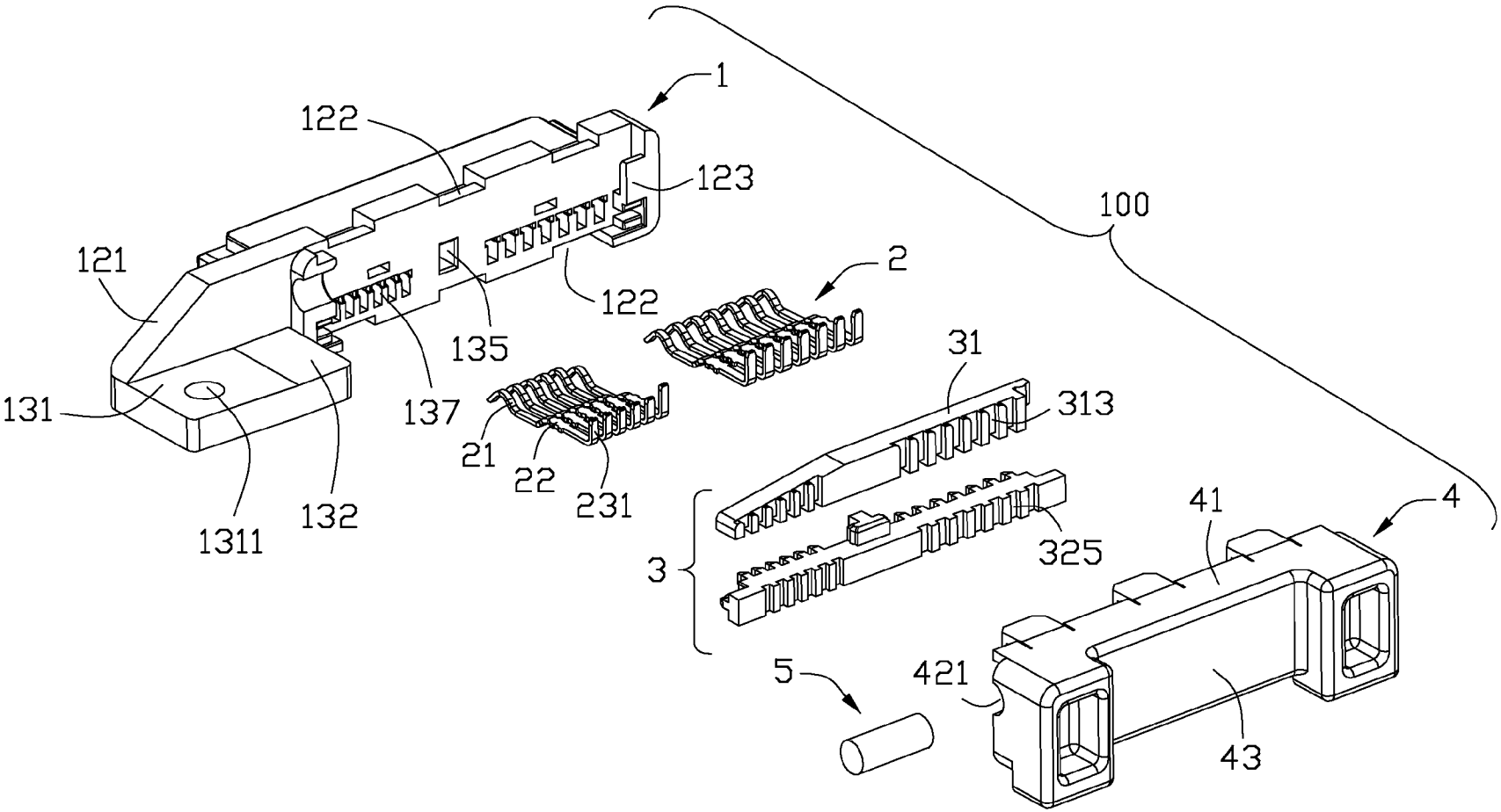
FIG. 3 is a view similar to FIG. 2, but taken from a different aspect.
Figure 4:
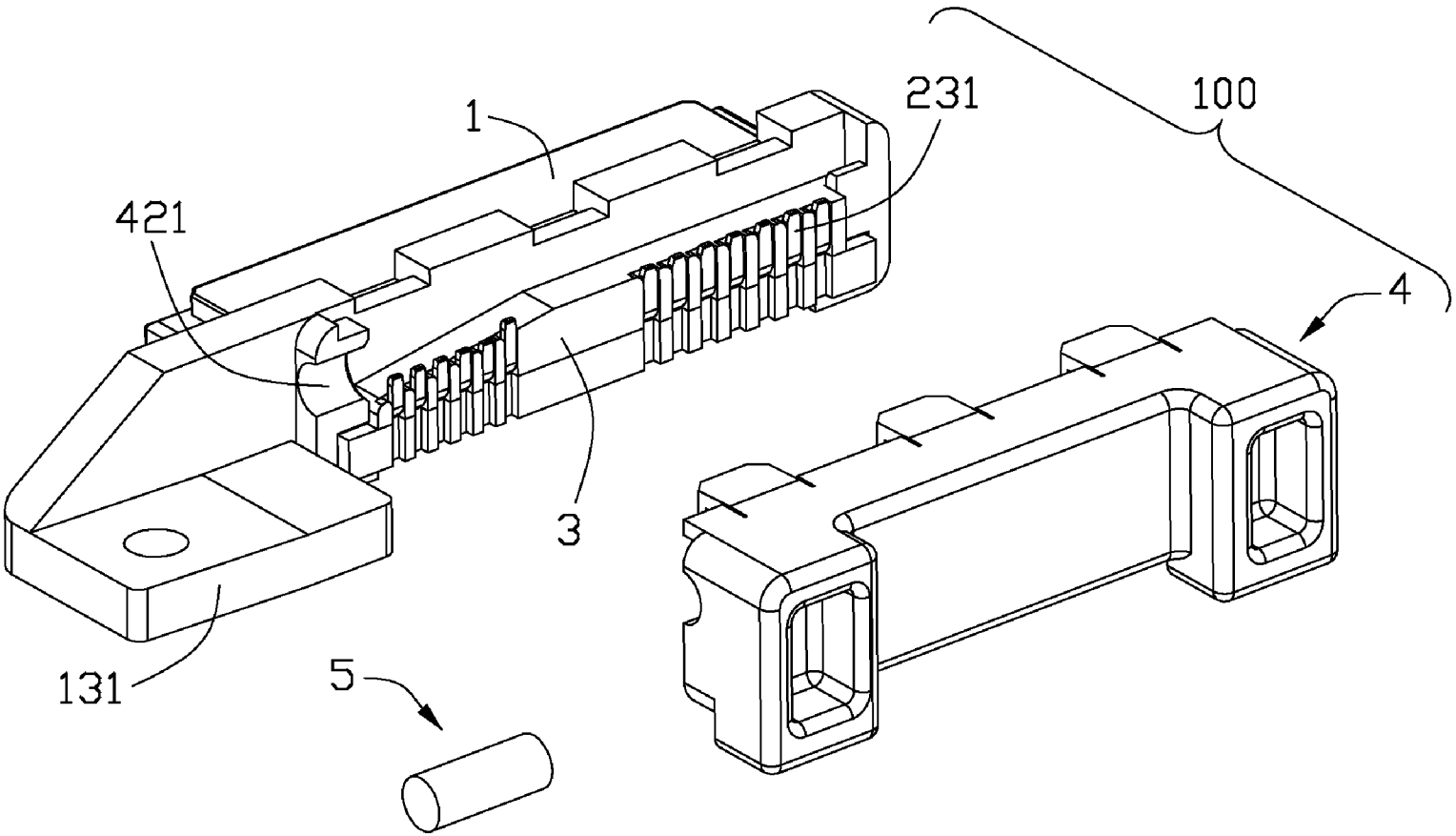
FIG. 4 is an assembled perspective view of part components of the electrical connector assembly of the present invention.
Figure 5:
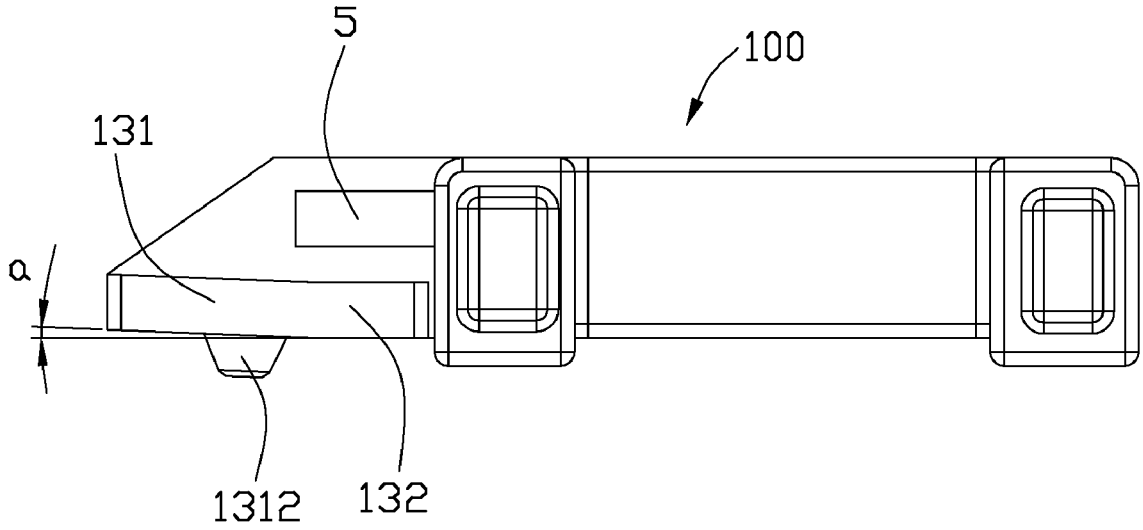
FIG. 5 is a rear elevational view of the electrical connector assembly in according with the present invention.
Figure 6:
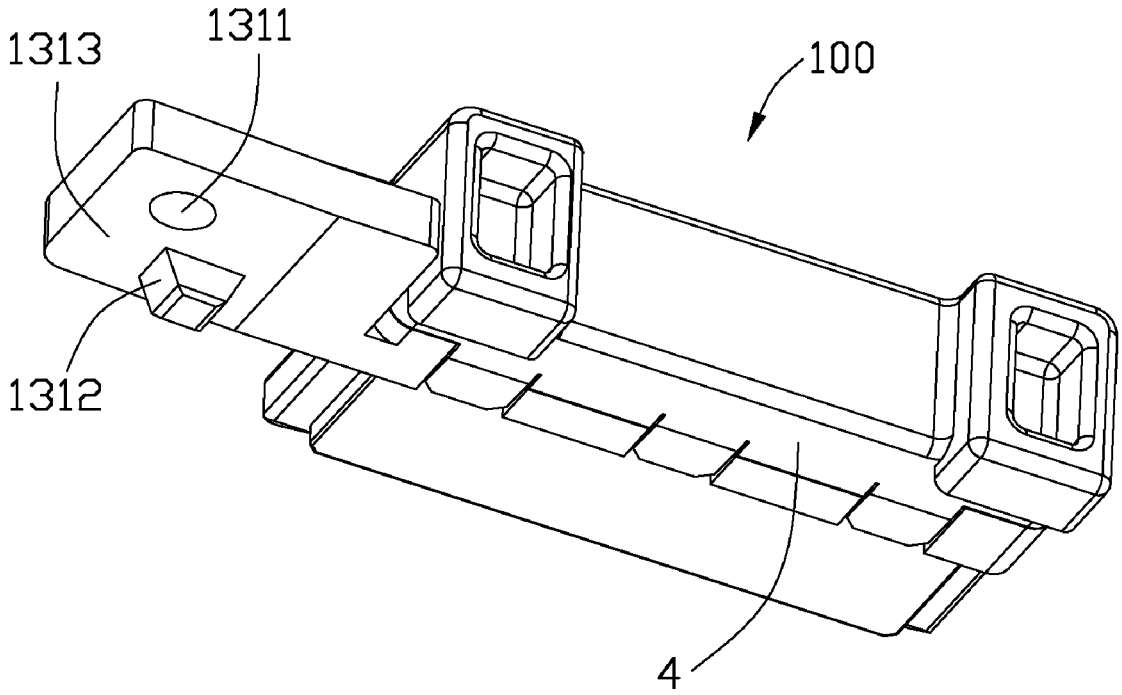
FIG. 6 is a bottom plan view of the electrical connector assembly in according with the present invention.

Reference to FIGS. 1 to 6, an electrical connector 100 in according with a preferred embodiment of the present invention is shown. The electrical connector 100 comprises a housing 1, a plurality of contacts 2 received in the housing 1, a spacer 3 assembled on the housing 1 for fastening the contacts 2, a cover 4 assembled on the housing from rear to front, and a plurality of wires of the cable 5 connected to the contacts 2.

The housing 1 comprises a lengthwise base portion 12, a mating portion 11 frontward extending from the base portion 12, and a fastening portion 13 extending from one side of the base portion 12. The mating portion 11 defines a mating direction and comprises a plurality of receiving slots 111, 112 which are divided into two part by a board. The base portion 12 is wider and higher than the mating portion 11 and comprises a plurality of fastening gaps 122 located on the top surface and bottom surface thereof, and an inclined surface 121 extending from one side of the top surface to the fastening portion 13. The receiving slots 111, 112 pass through the mating portion 11 and the base portion 12 to form two group of rectangular holes 137 on the rear wall of the base portion 12. A rectangular fastening hole 135 is formed between the two groups of rectangular holes 137. A blocking wall 123 rearward extends from the base portion 12 to define a L-like configuration in a top view and form a receiving space between the blocking wall 123 and the base portion 12.

The fastening portion 13 rearward extending from the bottom surface of the base portion 12 and comprises a horizontal board 132 and an inclined board 131 extending from the horizontal board 132. The inclined board 131 comprises a the inclined plane 1313 which an angle $\alpha$ is formed between the horizontal plane and. The angle $\alpha$ is formed between an inclined line on the inclined plane 1313 and a horizontal line extending along a direction perpendicular to the mating direction on the horizontal plane. The inclined board 131 further comprises an elliptic fastening hole 1311 and a subuliform pole or mounting post 1312 extending from the inclined plane 1313 thereof.

Each of the contacts 2 comprises a mating piece 21, a tail 231 upward bend, and a connecting piece 22 connecting the tail 231 to the mating piece 21. The mating piece 21 and the connecting piece 22 are received in the housing 1 and the tail 231 extending to be exposed out of the housing 1 to be exposed behind the rear wall of the base portion 12 of the housing 1.

The spacer 3 is located between the tails 231 of the contacts 2 and the base portion 12 of the housing 1 and comprises an upper portion 31 and a lower portion 32 assembled with the upper portion 31. The upper portion 31 and the lower portion 32 form two slots therebetween and the tails 231 of the contacts 2 extending through the slots of the spacer 3. The upper portion 31 and the lower portion 32 respectively comprises a plurality of receiving grooves 313, 325 for receiving the tails 231 of the contacts 2 and the wires of the cable 5. The upper portion 31 comprises a gap 311 and the lower portion 32 comprises a protrusions 323 corresponding to the gap 311 and the fastening hole 135 of the base portion 12 for assembling the lower portion 32 with the upper portion 31 and assembling the spacer 3 on the housing 1. The upper portion 31 has a top surface with a horizontal plane and an inclined plane 312 extending from the horizontal plane. A wing portion 314 extends from one side of the upper portion 31 and corresponds to the blocking wall 123 of the housing for the wing portion 314 can be received in the receiving space between the blocking wall 123 and the base portion 12. The lower portion 32 further comprises a plurality of blocks 322 frontward extending from the front surface thereof and be inserted into the rectangular holes 137 for fixing the contacts 2.

The cover 4 comprises a top wall 41, a bottom wall 42 and a rear wall 43 connecting the top wall 41 and the bottom wall 42. The top wall 41, the bottom wall 42 and the rear wall 43 together form a receiving space 44. A plurality of fastening protrusions 411 are respectively formed on the top wall 41 and the bottom wall 42 for corresponding to the fastening gaps 122 of the housing 1. A hole is formed between the cover 4 and the base portion 12 for providing a passageway for cables.

When the electrical connector 100 is assembled in an electric device, the inclined board 131 of the fastening portion 13 attaches to an inclined fastening surface (not shown) of the electric device, the horizontal board 132 attaches to a horizontal fastening surface (not shown), and the subuliform pole 1312 is inserted into a fastening hole of the inclined fastening surface. The fastening hole 1311 corresponds to another hole of the inclined fastening surface, and the electrical connector 100 is assembled on the fastening surface through a nut passing trough the fastening hole and the hole of the inclined fastening surface. The rear wall of the cover 4 attaches a wall of the electric device, and the right side surface of the electrical connector 100 attaches another wall of the electric device for prevent the electrical connector 100 moving.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a housing located in a front of the electrical connector;

a plurality of contacts received in the housing;

a plurality of wires of a cable connected to the contacts; and a cover assembled to the housing; wherein the housing further comprises a base portion, a mating portion frontward extending from the base portion and defining a mating direction, and a fastening portion rearward extending from the base portion, the fastening portion comprises a bottom surface defining an inclined plane via which an angle is formed with regard to a horizontal plane.

2. The electrical connector as claimed in claim 1, wherein the fastening portion comprises a horizontal board and an inclined board extending from the horizontal board, the inclined plane is located on the inclined board.

3. The electrical connector as claimed in claim 1, wherein the angle is also formed between an inclined line on the inclined plane and a horizontal line extending along a direction perpendicular to the mating direction on the horizontal plane.

4. The electrical connector as claimed in claim 3, wherein the inclined board comprises a hole and a pole located on the bottom surface thereof.

5. The electrical connector as claimed in claim 4, wherein the pole is of subuliform configuration.

6. The electrical connector as claimed in claim 5, further comprising a spacer, each of the contacts comprising a tail connected to its corresponding cable, the spacer being located between the housing and the tails of the contacts.

7. The electrical connector as claimed in claim 6, wherein the spacer comprises an upper portion and a lower portion assembled with the upper portion, the upper portion and the lower portion form two slots therebetween and the tails of the contacts extending through the slots of the spacer.

8. The electrical connector as claimed in claim 7, wherein the upper portion and the lower portion of the spacer respectively comprise a plurality of receiving slots for receiving the tails of the contacts.

9. The electrical connector as claimed in claim 1, wherein the base portion of the housing comprises a top surface and a inclined surface extending from one side of the top surface to the fastening portion.

10. The electrical connector as claimed in claim 9, wherein the base portion of the housing comprises a plurality of fastening gaps on the top surface and bottom surface thereof, the cover comprises a plurality of fastening protrusions corresponding to the fastening gaps.

11. An electrical cable connector assembly comprising:

an insulative housing including a forwardly extending mating portion in a mating direction;

a plurality of passageways extending from a rear face of the housing into the mating portion in the mating direction;

a plurality of contacts disposed in the corresponding passageways, respectively, each of said contacts defining a front contacting section exposed in the mating portion, and a rear soldering section extending away from the corresponding passageway in a vertical direction perpendicular to said mating direction and located behind and essentially parallel the rear face;

a cable including a plurality of wires mechanically and electrically connected to the contacting sections of the corresponding contacts, respectively;

a first spacer defining a plurality of first groove structures formed behind the rear face and extending in the vertical direction to respectively receive the soldering sections of the corresponding contacts therein;

a second spacer closely arranged beside the first spacer and defining a plurality of second groove structures formed behind the rear face and extending in the vertical direction to respectively receive the wires therein.

12. The electrical cable connector assembly as claimed in claim 11, wherein the first groove structures are aligned with the second groove structures, respectively.

13. The electrical cable connector assembly as claimed in claim 11, said second spacer blocks rear openings of the passageways for preventing contamination of the contacts.

14. The electrical cable connector assembly as claimed in claim 11, wherein said first spacer is discrete from the housing while assembled thereto.

15. The electrical cable connector assembly as claimed in claim 11, wherein the housing and the second spacer formed locking structures to allow said second spacer to be assembled to the rear face of the housing only in said mating direction.

16. The electrical cable connector assembly as claimed in claim 11, further including a cover to shield the rear face of the housing and cooperate with the housing to sandwich the cable therebetween in said mating direction.

17. An electrical cable connector assembly comprising:

an insulative housing defining a forwardly extending mating portion in a mating direction, a base located behind the mating portion and a fastening portion unitarily extend from the base portion and essentially located around an end of the base in a lengthwise direction perpendicular to said mating direction;

at least a portion of said fastening portion defining a segment with an oblique bottom surface which is offset, with a tiny angle, from an imaginary horizontal plane defined along said lengthwise direction; and a fastening hole extending through said segment in a vertical direction perpendicular to said imaginary plane while being oblique to said oblique bottom surface; wherein said fastening hole forms an elliptic configuration at the oblique bottom surface.

18. The electrical cable connector assembly as claimed in claim 17, wherein said segment is further equipped with a tapered type mounting port unitarily extending downwardly from the oblique bottom surface and defining thereof an center axis which is offset from the vertical direction with said tiny angle.

19. The electrical cable connector assembly as claimed in claim 18, wherein said mounting post defines a square configuration on an interface with the oblique bottom surface.

20. The electrical cable connector assembly as claimed in claim 17, wherein said segment defines an upper surface parallel to the oblique bottom surface.

* * * * *